US007647702B2

(12) United States Patent
Polei

(10) Patent No.: US 7,647,702 B2
(45) Date of Patent: Jan. 19, 2010

(54) UTILITY KNIFE

(75) Inventor: Gudula Polei, Solingen (DE)

(73) Assignee: Martor KG, Solingen (DE)

( * ) Notice: Subject to any disclaimer, the term of this patent is extended or adjusted under 35 U.S.C. 154(b) by 91 days.

(21) Appl. No.: 11/605,196

(22) Filed: Nov. 28, 2006

(65) Prior Publication Data

US 2007/0119056 A1 May 31, 2007

(30) Foreign Application Priority Data

Nov. 29, 2005 (DE) ..... 10 2005 057 213

(51) Int. Cl.
*B26B 1/08* (2006.01)
*B26B 1/10* (2006.01)

(52) U.S. Cl. ..... 30/162; 30/320; 30/329; 30/335; 30/340

(58) Field of Classification Search ..... 30/162, 30/320, 329–339
See application file for complete search history.

(56) References Cited

U.S. PATENT DOCUMENTS 2,607,987 A * 8/1952 Bettenhausen ..... 30/293
4,139,939 A * 2/1979 Crooks ..... 30/2
4,320,576 A 3/1982 Beermann
4,769,912 A * 9/1988 Davis ..... 30/162
5,012,581 A * 5/1991 Fletcher et al. ..... 30/162
5,203,085 A * 4/1993 Berns ..... 30/162
5,303,474 A * 4/1994 Keklak et al. ..... 30/162
5,426,855 A * 6/1995 Keklak et al. ..... 30/162
5,581,890 A * 12/1996 Schmidt ..... 30/162
5,813,121 A * 9/1998 Gringer ..... 30/162
5,966,817 A * 10/1999 Lee ..... 30/162
6,233,832 B1 5/2001 Berns
7,322,110 B2 * 1/2008 Hernandez et al. ..... 30/162

FOREIGN PATENT DOCUMENTS

DE 82 18 916 10/1982

* cited by examiner

*Primary Examiner*—Boyer D. Ashley
*Assistant Examiner*—Edward Landrum
(74) *Attorney, Agent, or Firm*—Andrew Wilford

(57) ABSTRACT

A utility knife for use with a replaceable flat blade, has an elongated housing having a longitudinally extending guide open at the front end, a longitudinally extending and transversely open slot, and a longitudinally extending holding face directed transversely opposite to the stop. A blade holder having a seat for the blade is slidable in the housing between a front use position forwardly bearing on a longitudinally displaceable stop and with the blade projecting longitudinally forwardly from the guide past the front end and a rear storage position with the blade wholly contained in the housing rearward of the front end and the holder out of engagement with the stop. The stop can be secured in any of a plurality of longitudinally offset positions in the housing to adjust the front position of the blade.

10 Claims, 4 Drawing Sheets

UTILITY KNIFE

FIELD OF THE INVENTION

The present invention relates to a utility knife. More particularly this invention concerns such a knife with a replaceable and retractable blade.

BACKGROUND OF THE INVENTION

A standard utility knife for use with a replaceable flat razor blade has as described in U.S. Pat. No. 4,320,576 an elongated housing having a front end, a longitudinally and longitudinally extending guide open at the front end, a longitudinally extending and transversely open slot, and a longitudinally forwardly directed holding face directed transversely opposite to the slot. A blade holder having a seat for the blade is slidable in the housing between a front use position with the blade projecting longitudinally forward from the guide at the front end and a rear storage position with the blade wholly contained in the housing rearward of the front end. An actuator connected to the holder and exposed at the slot is accessible from outside the housing and operable to shift the blade in the holder between its front and rear positions. A spring braced between the holder and the housing urges the holder and the actuator longitudinally rearward in the housing toward the rear position. Thus it is possible to hold the knife with the blade in the use position by a small force exerted against the actuator, but as soon as the actuator is released the blade snaps back into the housing so that the knife can be safely pocketed.

A knife housing front edge surrounding the blade exit opening of the guide is configured at an angle to a longitudinal blade movement direction, such that the knife housing front edge extends away from the front of the blade toward the back. This way, while cutting, the knife can be held ergonomically at a an obtuse angle relative to the material to be cut, without the knife housing front edge coming in contact with the material to be cut during cutting and impairing the cut.

A similar knife is also illustrated in the comprehensive catalog from Martor KG, Solingen, January 2002, under the heading "Professional Applications" on pages 14 to 21 in various embodiments. On a wide knife housing side, the knife has a longitudinal slot, in which an operating projection is guided that actuates the blade holder. On the end at the blade exit side, the knife housing is set at an obtuse angle relative to the blade movement direction. The knife for left-handed users has the operating projection on the other wide housing side, which means that it is configured mirror-reversed. As a result, two different knives have to be produced for right-handed and left-handed users.

Furthermore, safety knives of this type are offered with varying blade extension lengths depending on the application. Knives with varying blade extension lengths are offered for right-handed and left-handed users, respectively. Consequently, a large number of knives is produced, resulting in high technical and organizational expenses, which affects overall costs.

From the related art, furthermore knives are known, which can be used by right-handed and left-handed users alike. These knives comprise, for example, longitudinal slots on both wide housing sides for an operating projection. The disadvantage with these knives, however, is that the second actuator requires additional manufacturing expenses. In other known systems, such as for example seen in German utility model 82 18 916 and U.S. Pat. No. 6,233,832, the actuator is provided on a rear edge of the blade housing, so that the same knife can be used with equal comfort both by right- and left-handed persons.

Furthermore, knives given sold under the trade name "Cuttex" are known from pages 180 and 181 of the comprehensive catalog of Martor KG, Solingen, January 2002. The knives have a snap-off blade with predetermined break lines. The blade holder is slidable the knife housing and is provided with a snap-fit element that can engage with recesses provided on one side of the housing in the blade movement direction. The engagement of the snap-fit element firmly locks the blade holder and consequently also the blade in a certain locked position, for example the cutting position, in which the blade projects from a blade exit hole. To move the blade to the rear storage position, the snap-fit element must be released from the recess and the blade must be retracted into the housing. Thus this knife is not a safety knife that automatically retracts the blade into the knife housing as soon as the pressure that is applied on the operating projection has eased and/or a cutting reaction force on the blade is removed.

In the knife used with the breakaway blade, the housing front edge of the knife that surrounds the blade exit hole has a first region that is inclined relative to the blade movement direction and extends away from the blade front toward the back. This way, the knife housing cannot come in contact with the material to be cut during cutting and impair the cut. A further second region of the knife housing front edge is inclined parallel to the predetermined cutting lines of the blade segments. This way, a used dull blade segment is easy to break off and a new, unused blade segment can be easily moved into the cutting position. The second region of the knife housing front edge that extends parallel to the predetermined break line, serves as a contact edge for the blade when breaking off the blade. As a result, no tool is required for breaking off the dull blade.

OBJECTS OF THE INVENTION

It is therefore an object of the present invention to provide an improved utility knife.

Another object is the provision of such an improved utility knife that overcomes the above-given disadvantages, in particular that, starting with a knife such as described in above-cited US '576, is equally usable by right-and left-handed persons.

SUMMARY OF THE INVENTION

A utility knife for use with a replaceable flat blade has according to the invention an elongated housing having a V-shaped front end formed by a pair of flat flanks extending at a rearwardly obtuse angle to each other and meeting at a central forwardly directed point. The housing further has a longitudinally and longitudinally extending guide open at the front end, a longitudinally extending and transversely open slot, and a longitudinally extending holding face directed transversely opposite to the slot. A blade holder having a seat for the blade is slidable in the housing between a front use position with the blade projecting longitudinally forwardly from the guide past the front end and a rear storage position with the blade wholly contained in the housing rearward of the front end. An actuator connected to the holder and exposed at the slot is accessible from outside the housing and operable to shift the blade in the holder between its front and rear positions. A spring braced between the holder and the housing urges the holder and the actuator longitudinally backwardly in the housing toward the rear position. The blade can be secured in the front position or at at least one intermediate position between the front and rear positions.

The basic idea of the invention is that due to the angled V-shaped knife front end the knife can be used comfortably both by right-handed and left-handed users in that the blade can be inserted in the blade holder in two different positions. In addition, the maximum advancement positions of the blade holder can be defined using the adjustable and lockable stop element, and as a result different blade extension lengths can be set using the same knife.

The advantage of the invention is that manufacturing expenses are significantly reduced because it is no longer required to make separate, mirror-reversed knives for right- and left-handed users. Furthermore, another longitudinal slot with operating projection for the blade holder is no longer required on the second knife housing side. On knives with the additional longitudinal slot, greater amounts of contaminants may penetrate into the knife housing and impair functioning of the knife. Furthermore, it is no longer necessary to produce knives with varying blade extension lengths. The knife according to the invention allows the blade extension length to be adjusted. Once set, the user can push out the blade without paying attention as it is only the maximum extension that is limited Furthermore, the knife according to the invention ensures more comfortable manipulation than knives with operating projections on both sides. In the case of knives with operating projections on both sides, movement of the additional operating projection may be impaired by the palm enclosing the knife housing. Furthermore, the additional operating projection as well as the additional longitudinal slot may prevent the user from firmly gripping the knife. The knife according to the invention overcomes these disadvantages and can still be handled by right-handed and left-handed users alike. In addition, the knife according to the present invention offers greater design freedom regarding the shape of the knife, since an additional operating projection limits the design freedom of the knife.

According to a first embodiment, the stop device comprises a stop element that is provided in. the travel path of the blade holder. Since the stop element is located in the travel path of the blade holder, the blade holder can only be. displaced until it comes into contact with the stop element. Undesirable advancement of the blade holder beyond a defined length is therefore safely prevented.

According to a further embodiment, the stop element can be displaced in translatory movements in the direction of movement of the blade holder. The stop element may be displaceable, for example, parallel to the travel path of the blade holder. When the stop element is guided parallel to the travel path of the blade holder, displacement of the stop element by a certain amount may move the maximum blade advancement and consequently the blade extension length by the same amount. The amount by which the stop element is adjusted may therefore equal the amount by which the extension length of the blade is varied. Furthermore, the adjustability of the stop element may be continuous.

According to a further embodiment of the invention, the stop element is fastened at least directly to the knife housing. The stop element may be mounted directly on the knife housing, or it may be attached, for example, to a part that is fastened to the knife housing.

According to a further embodiment, the stop element is interacts with a retaining device that can be displaced between a locking position in which the stop element is fixed firmly in place and a release position in which the stop element can be moved longitudinally between various positions. The retaining device thus allows the stop element to be fixed in various positions and to be released again.

According to a further embodiment, the retaining device has a screw element or threaded part whose screwthread interacts with a screwthread that is connected at least indirectly to the stop element. As a result of the screw element, it is easily possible to change the retaining device from a locking position to a release position in that the screw is screwed into or out of the thread of the stop element.

According to a further embodiment of the invention, the screw element extends at least in part through an elongated slot or hole that is associated at least indirectly with the knife housing. The screw element may be guided by the inside edges of the elongated hole. This way, the motion of the stop element is also guided indirectly by the inside edges of the elongated hole. In addition, an elongated hole may limit the adjustment range of the stop element.

According to a further embodiment, the stop element is guided on edges of the elongated hole. As a result, the stop element does not have to be guided indirectly by the screw element. The guide surfaces of the stop element interacting with the inside edges may be configured to be flat and engage the slot edges flatly. This allows the stop element to be guided with great precision. The guide surfaces of the stop element may be configured such that they prevent rotation of the stop element. This prevents unintentional rotation of the stop element in a simple manner.

According to a further embodiment, the stop element non-positively or positively interacts with wall surfaces adjoining the elongated hole. The stop element may be held non-positively, for example, on the inside surfaces of the knife housing or an insert attached to the knife housing. When using a screw connection, it is easily possible to prevent movement of the stop element by simple friction. A positive connection can be achieved, for example, by structuring the corresponding surfaces of the stop element and knife housing or insert. By releasing the retention device, the stop element may be released transversely to the adjustment direction from the frictional connection and then be adjusted.

According to a further embodiment of the invention, the knife housing is formed in part by an insert. The insert may be attached to the knife housing and then be released again. The insert may be associated with certain knife functions. It is possible, for example, to change the blade by separating the knife housing and the insert. Furthermore, a restoring spring may be connected between the insert and blade holder, which spring applies rearward pressure on the blade so that the blade is retracted in the knife housing and inaccessible to the user. Also the elongated slot hole as well as the retention device and stop device may be provided on the insert. The insert may be held against the knife housing using a snap-fit connection.

According to a further embodiment, the blade holder is held non-positively or positively on the insert in the non-usage position. This way it is easy to remove-the insert from the knife housing in order to change the blade, without the possibility of losing individual parts of the knife. The insert and the blade holder form a unit, which may be removed as one piece from the knife housing.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
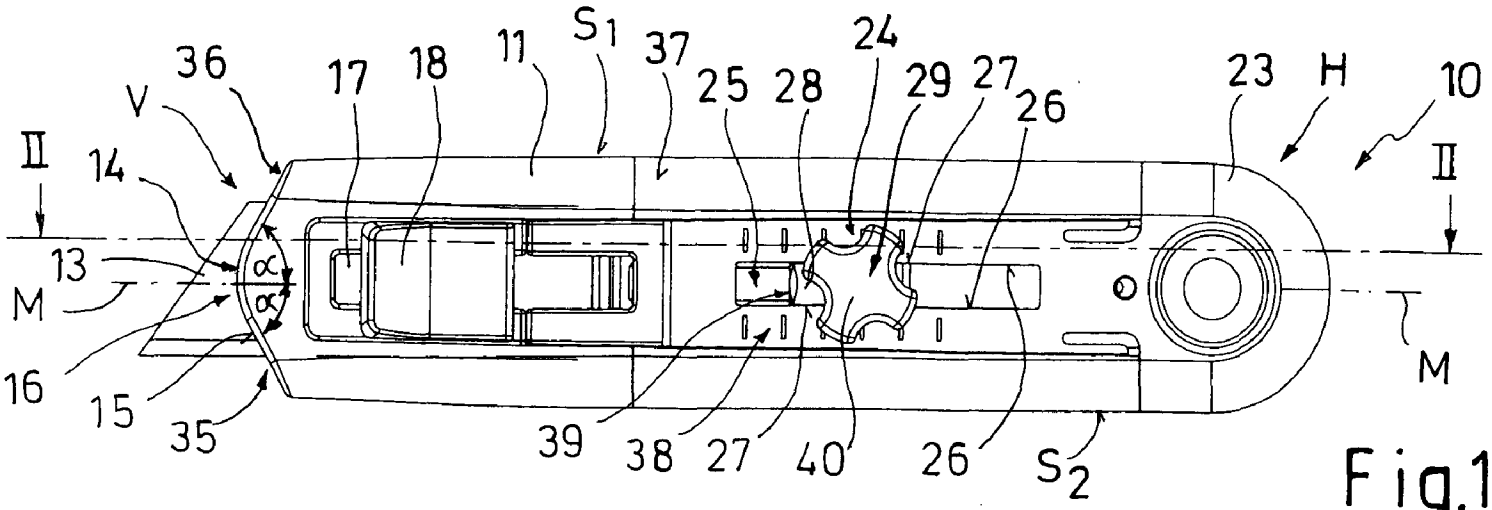
FIG. 1 is a side view showing the knife with the blade in the front extended position.

As seen in the drawing, a knife 10 has a housing 11 as well as a blade 13 that is fitted to a blade holder 12. A front end V of the housing 11 is formed with a hole 14 from which the blade 13 can extend. The hole 14 opens at a front edge 15 that is directed longitudinally forward relative to a longitudinal axis M of the knife housing 11 and forms a front central point or tip 16 of the knife housing 11. The housing front edge 15 is angled back toward the rear knife end H at an obtuse angle $\alpha$ to the longitudinal axis M as a pair of flat flanks 35 and 36.

The knife housing 11 is provided with a longitudinal slot 17 on a flat knife housing face 37, in which slot 17 an actuator or operating projection 18 for the blade holder 12 is guided. The blade holder 12 is slidable in a guide A of the knife housing 11, so that the holder 12 can be displaced between a non-usage rear position shown in FIG. 2 and a front cutting position shown in FIG. 1. In the FIG. 1 cutting position, the blade holder 12 is advanced to a maximum and the blade 13 projects from the housing hole 14. In the non-usage position, the blade 13 is completely retracted in the guide A and inaccessible to the user of the knife 10, eliminating any risk of injury.

The blade holder 12 has a base plate 21 as well as a cover plate 22 that is pivotable on the base plate 21. The blade 13 is positively secured between the base plate 21 and the cover plate 22 by pins integrally formed on the cover plate 22 and extending through recesses in the blade 13 in a manner known per se.

The blade holder 12 is guided laterally between inside surfaces 19 and 20 of the guide A. As a result, the base plate 21 and cover plate 22 cannot be separated from each other as long as the blade holder 12 is engaged in the guide A of the knife housing 11. The blade 13 is consequently held safely between the base plate 21 and cover plate 22. Only when the blade holder 12 is removed from the housing 11 is it possible to pivot the cover plate 22 off the base plate 21 to allow removal of the blade 13.

Figure 2:
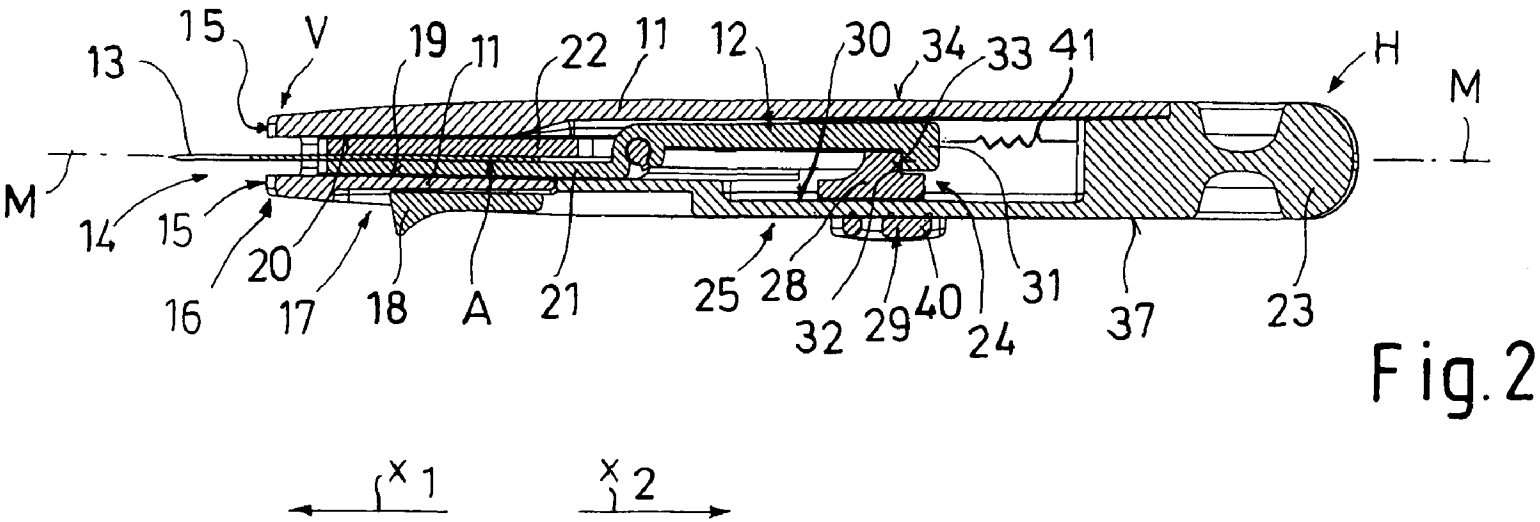
FIG. 2 is a section taken along line II-II of FIG. 1.
Figure 3:
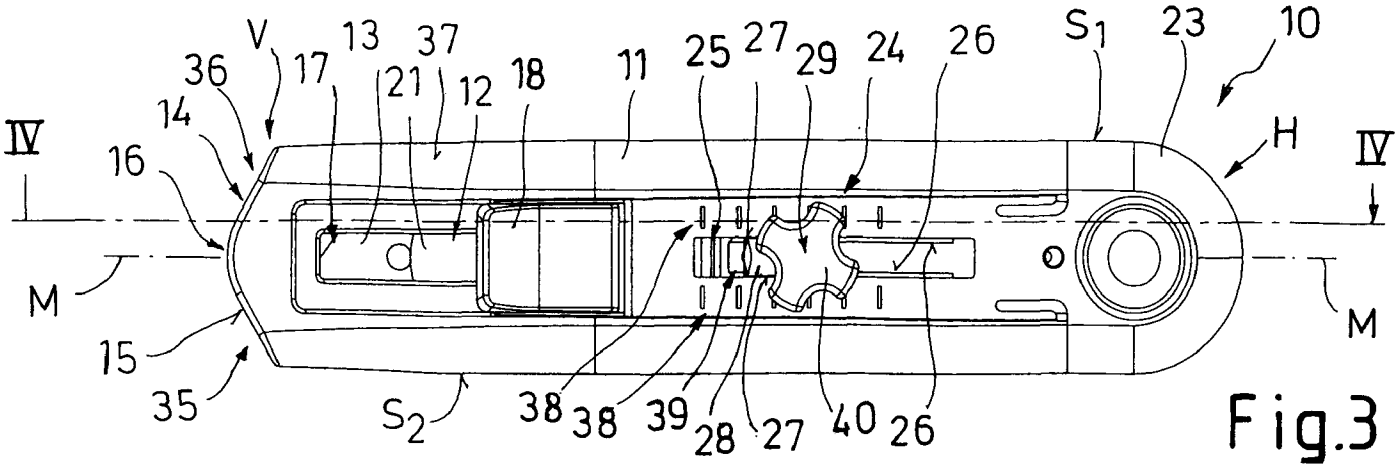
FIG. 3 is a view like FIG. 1 but with the blade in the rear retracted or storage position.
Figure 4:
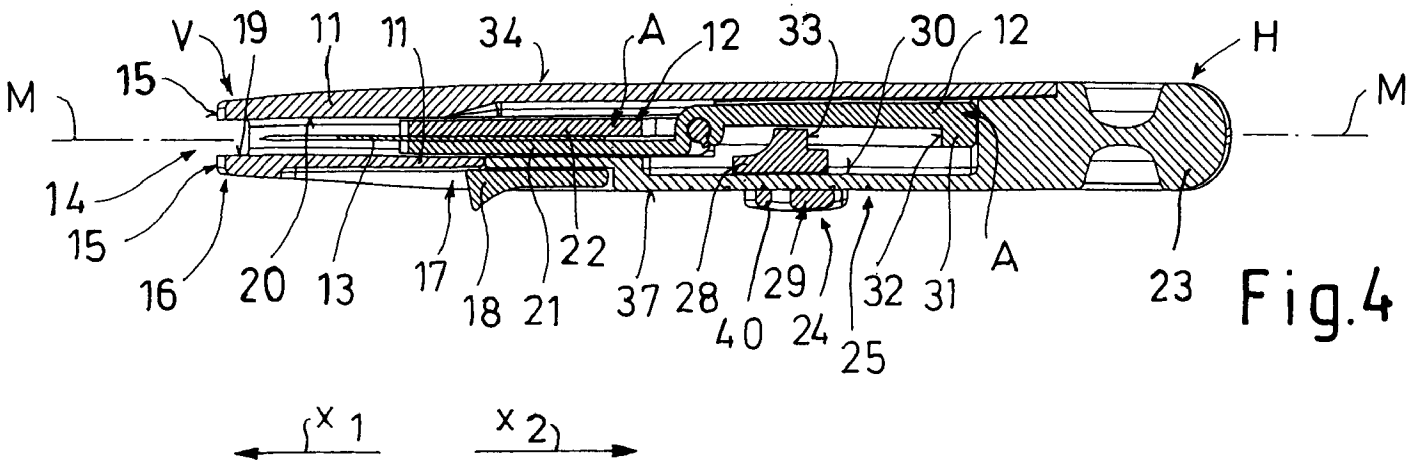
FIG. 4 is a section taken along line IV-IV of FIG. 3.

A helical tension spring shown schematically in FIG. 2 at 41 has one end anchored on the blade holder 12 and with an opposite other end on an insert 23 normally forming part of the housing 11. In the non-usage position, the tension spring applies pressure on the blade holder 12 in a rearward direction $x_2$. The insert 23 may be inserted into the knife housing 11 from a back end and snapped in place. The insert 23 may be released and pulled out of the knife housing 11 to change the blade 13.

The insert 23 is associated with an adjustable and lockable stop device 24. A stop element 28 of the adjustable and lockable stop device 24 is provided in the travel path of the blade holder. 12. The insert 23 forms a longitudinally elongated hole or slot 25 having inside edges 26 that form guide surfaces for outer edges 27 of a center part 39 of the stop element 28, which part 39 projects into the elongated hole 25. The stop element 28 may be tightened against an inside wall surface 30 of the insert 23 using a screw element 29 and thus be fastened solidly in various positions along the slot 25 and later be released again. The projecting region 39 of the stop element 28 interacts with the inside edges 26 to prevent rotation so that the stop element 28 cannot rotate when the screw element 29 is loosened.

The blade holder 12 has a shoulder 31 with a contact surface 32. As a result of the operating projection 18, the blade holder 12 is displaceable longitudinally in a straight line from the non-usage position in a forward direction $x_1$ until a contact surface 32 of the shoulder 31 comes into contact with a stop surface 33 of the stop element 28.

Adjustment of the maximum advancement position is possible in that first the screw element 29 is screwed out of the stop element 28 using a screw head 40 until the clamping connection between the stop element 28 and the inside wall 30 of the insert 23 has been released. In this position the screw element 29 is not released fully by the stop element 28, so that the screw element 29 can be displaced together with the stop element 28 in the directions $x_1$ and $x_2$. Following displacement of the stop element 28 to the desired position, the screw element 29 is screwed back into the stop element 28 until the stop element 28 is locked to the inside wall 30 of the insert 23 and can no longer be displaced. The stop surface 33 of the stop element 28 thus forms a firm stop for the contact surface 32 of the blade holder 12 and the blade holder 12 can only be advanced until the contact surface 32 has come into contact with the stop surface 33. Markings or indicia 38 are provided on the insert 23 on both sides of the elongated hole 25 to facilitate setting of defined positions of the stop element 28.

Figure 6:
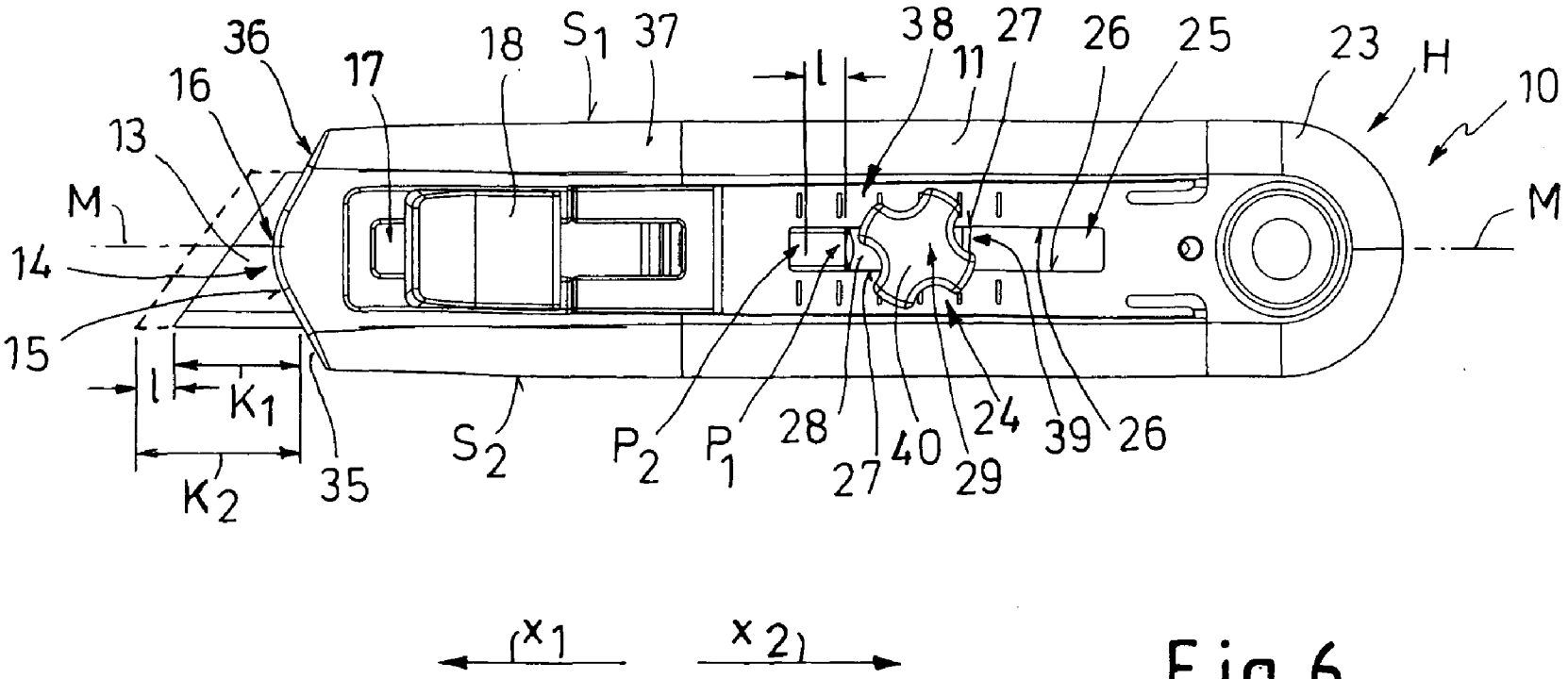
FIG. 6 is a view like FIG. 1, but showing the blade in two different positions.

When the operating projection 18 is moved to the furthest front position, in which the shoulder 31 of the blade holder 12 comes into contact with the contact surface 32 of the stop element (see FIG. 2), a maximum blade extension length of the blade 13 has been reached. If according to FIG. 6 the stop element 28 is displaced from the position $P_1$ by an amount 1 (FIG. 6) in the direction $x_1$ into the position $P_2$ indicated by a dashed line, the longitudinal blade extension $K_1$ is also increased by the amount 1, resulting in a blade extension $K_2$.

Right-handed users will actuate the operating projection 18 according to FIG. 1 using the right thumb, while the remaining fingers of the right hand and/or the palm enclose the opposite knife housing side 34, forming a substantially flat and ergonomically comfortable contact surface or grip. The flank 35 on the front V of the knife housing 11 ensures that, when the knife 10 is held at an angle to a workpiece being cut, the lower narrow side $S_2$ of the knife 10 in the front region V does not come into contact with the material to be cut and impair the cut.

Figure 5:
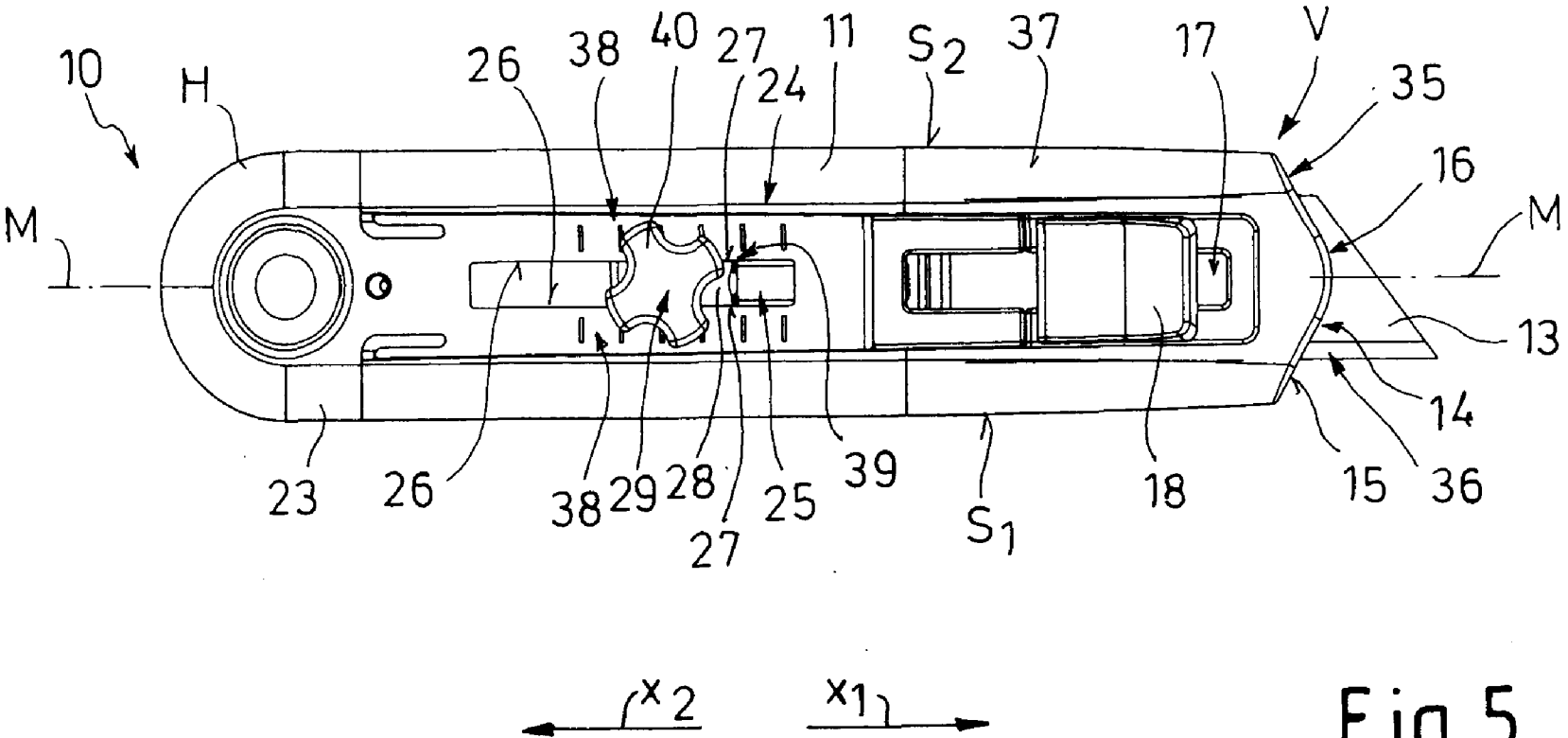
FIG. 5 is a view like FIG. 1, but with the blade reversed.

In FIG. 5, the blade 13 is inserted mirror-reversed in the blade holder 12 relative to the knife 10 shown according to FIG. 1, so that the knife can be handled by a left-handed user. The operating projection 18 is actuated by the left thumb and the remaining fingers of the left hand enclose the knife housing 11. When the knife 10 is held at an angle, the second inclined flank 36 on the front V of the knife housing 11 now allows the cut to be guided also by left-handed users without engagement of the workpiece with the lower narrow side $S_1$ on the material to be cut so as to impair the cut.

I claim:

1. A utility knife for use with a replaceable flat blade, the knife comprising:

an elongated housing having a front end, a longitudinally extending guide open at the front end, a longitudinally extending and transversely open slot, and a longitudinally extending holding face directed transversely opposite to the slot;

a stop longitudinally shiftable in the housing and having a stop face;

a blade holder having a seat for the blade and slidable in the housing between a front use position forwardly bearing on the stop face and with the blade projecting longitudinally forwardly from the guide past the front end and a rear storage position with the blade wholly contained in the housing rearward of the front end and the holder out of engagement with the stop, the stop face and holder being so constructed and arranged that the holder cannot move forward in the housing when the holder is engaging the stop face, the holder being out of engagement with the stop face when not in the front position;

an actuator connected to the holder, exposed at the slot, accessible from outside the housing, and operable to shift the blade in the holder between its front and rear positions;

a spring braced between the holder and the housing and urging the holder and the actuator longitudinally backwardly in the housing toward the rear position; and means for securing the stop in any of a plurality of longitudinally offset positions in the housing and thereby adjusting the front position of the blade.

2. The utility knife defined in claim 1 wherein the means for securing the stop includes a screw element.

3. The utility knife defined in claim 2 wherein the housing is formed with another slot and the screw element extends through the other slot.

4. The utility knife defined in claim 3 wherein the screw element bears transversely inwardly on an outer face of the housing and is threaded into the stop such that when tightened it presses the stop transversely outward against the housing.

5. The utility knife defined in claim 4 wherein the screw element and stop both overreach longitudinal edges of the other slot.

6. The utility knife defined in claim 1 wherein the stop face is directed rearward.

7. The utility knife defined in claim 1 wherein the housing includes an insert that comprises the slot.

8. The utility knife defined in claim 7 wherein the insert includes a surface of the guide.

9. The utility knife defined in claim 1 wherein the blade is elongated and has a longitudinally extending cutting edge.

10. The utility knife defined in claim 1 wherein the blade is fittable to the holder in two opposite positions with the cutting edge extending transversely oppositely.

* * * * *